US009400141B2

(12) United States Patent
Gustafsson et al.

(10) Patent No.: US 9,400,141 B2
(45) Date of Patent: Jul. 26, 2016

(54) PLATE HEAT EXCHANGER WITH STRENGTHENING SHEET

(75) Inventors: Helén Gustafsson, Stafanstorp (SE); Tomas Kovacs, Lund (SE)

(73) Assignee: ALFA LAVAL CORPORATE AB, Lund (SE)

( * ) Notice: Subject to any disclaimer, the term of this patent is extended or adjusted under 35 U.S.C. 154(b) by 1101 days.

(21) Appl. No.: 13/063,959

(22) PCT Filed: Sep. 11, 2009

(86) PCT No.: PCT/SE2009/051010

§ 371 (c)(1),
(2), (4) Date: Mar. 15, 2011

(87) PCT Pub. No.: WO2010/039086

PCT Pub. Date: Apr. 8, 2010

(65) Prior Publication Data

US 2011/0168371 A1 Jul. 14, 2011

(30) Foreign Application Priority Data

Oct. 3, 2008 (SE) ..... 0802084

(51) Int. Cl.
*F28F 3/08* (2006.01)
*F28D 7/02* (2006.01)
(Continued)

(52) U.S. Cl.
CPC ..... *F28D 9/005* (2013.01); *F28F 3/083* (2013.01); *F28F 3/046* (2013.01); *F28F 2225/04* (2013.01); *F28F 2265/12* (2013.01)

(58) Field of Classification Search
CPC ..... F28F 3/08; F28F 3/046; F28D 9/005
USPC ..... 165/164, 165, 166, 167, 906
See application file for complete search history.

(56) References Cited

U.S. PATENT DOCUMENTS 4,081,025 A * 3/1978 Donaldson ..... 165/140
4,911,235 A * 3/1990 Andersson et al. ..... 165/167
(Continued)

FOREIGN PATENT DOCUMENTS

CN 1158656 A 9/1997
CN 1297524 A 5/2001
(Continued)

OTHER PUBLICATIONS

Translation of Japanese Document JP 2000266479A labeled JP2000266479A.*
(Continued)

*Primary Examiner* — M. Alexandra Elve
*Assistant Examiner* — Paul Alvare
(74) *Attorney, Agent, or Firm* — Buchanan Ingersoll & Rooney PC

(57) ABSTRACT

The invention refers to a plate heat exchanger comprising a first end plate (1), a second end plate (2) and a number of heat exchanger plates (3), forming first plate interspaces (I) and second plate interspaces (II), in alternating order. The heat exchanger plates comprise a first outermost plate pair (5), a second outermost plate pair (6) and intermediate plate pairs (7). The first end plate and the heat exchanger plates comprise first porthole areas (11, 12) for first porthole channels (13, 14) for the formation of inlet and outlet for a first medium to and from the first plate interspaces, and second porthole areas (21, 22) for the formation of second porthole channels (23, 24) for inlet and outlet for a second medium to and from the second plate interspaces. The first porthole areas of the heat exchanger plates of the second outermost plate pair form portholes and the second porthole areas of these heat exchanger plates are closed.

11 Claims, 3 Drawing Sheets

(51) Int. Cl.

| | |
|---|---|
| ***F28F 3/00*** | (2006.01) |
| ***F28D 9/00*** | (2006.01) |
| *F28F 3/04* | (2006.01) |

(56) References Cited

U.S. PATENT DOCUMENTS

| | | | | | |
|---|---|---|---|---|---|
| 4,987,955 | A | * | 1/1991 | Bergqvist et al. | 165/167 |
| 5,174,370 | A | * | 12/1992 | Hallgren | 165/167 |
| 5,178,207 | A | * | 1/1993 | Bergqvist et al. | 165/70 |
| 5,226,474 | A | * | 7/1993 | Hallgren | 165/110 |
| 5,307,869 | A | * | 5/1994 | Blomgren | 165/167 |
| 5,435,383 | A | * | 7/1995 | Rajagopal | 165/167 |
| 5,462,113 | A | * | 10/1995 | Wand | 165/167 |
| 5,778,975 | A | | 7/1998 | Nilsson | |
| 5,810,071 | A | * | 9/1998 | Pavlin | 165/167 |
| 5,924,484 | A | * | 7/1999 | Andersson et al. | 165/167 |
| 5,964,283 | A | * | 10/1999 | Pavlin | 165/167 |
| 5,971,065 | A | * | 10/1999 | Bertilson et al. | 165/166 |
| 6,131,648 | A | * | 10/2000 | Rasmussen | 165/145 |
| 6,142,221 | A | * | 11/2000 | Johansson | 165/140 |
| 6,305,466 | B1 | | 10/2001 | Anderson et al. | |
| 6,394,179 | B1 | * | 5/2002 | Blomgren et al. | 165/167 |
| 6,478,081 | B1 | * | 11/2002 | Shaw | 165/167 |
| 6,530,425 | B2 | * | 3/2003 | Wehrmann et al. | 165/167 |
| 6,702,006 | B2 | | 3/2004 | Holm et al. | |
| 6,752,202 | B2 | * | 6/2004 | Holm et al. | 165/167 |
| 2003/0201094 | A1 | | 10/2003 | Evans et al. | |
| 2004/0069837 | A1 | | 4/2004 | Fujiyama et al. | |
| 2004/0112580 | A1 | * | 6/2004 | Jonsson et al. | 165/167 |
| 2005/0241814 | A1 | * | 11/2005 | Hendrix et al. | 165/167 |

FOREIGN PATENT DOCUMENTS

| | | | | | |
|---|---|---|---|---|---|
| CN | 1423742 | A | | 6/2003 | |
| JP | 7229687 | A | | 8/1995 | |
| JP | H07-280472 | | | 10/1995 | |
| JP | 2000266479 | A | * | 9/2000 | F28D 9/00 |
| JP | 2001280888 | A | | 10/2001 | |
| JP | 2002-195775 | | | 7/2002 | |
| WO | WO9708506 | A1 | | 3/1997 | |
| WO | WO9715797 | A1 | | 5/1997 | |
| WO | WO9946550 | A1 | | 9/1999 | |
| WO | WO0111301 | A1 | | 2/2001 | |
| WO | WO03071198 | A1 | | 8/2003 | |
| WO | WO2004025205 | A1 | | 3/2004 | |
| WO | WO2008073047 | A1 | | 6/2008 | |

OTHER PUBLICATIONS

JP Office Action dated Aug. 9, 2012 for Application No. 2011-530025.

Chinese Office Action issued Aug. 14, 2012, by the Chinese Patent Office, in corresponding Chinese Patent Application No. 200980139565 with English translation (11 pages).

* cited by examiner

PLATE HEAT EXCHANGER WITH STRENGTHENING SHEET

THE BACKGROUND OF THE INVENTION AND PRIOR ART

The present invention relates to a plate heat exchanger.

The plate heat exchanger according to the invention is in the first place intended for evaporation of a product, such as for instance caustic soda, sugar etc. through condensation of a heating medium which can be formed by the first medium. The product is comprised by or consist of the second medium which is transported through the second plate interspaces. Due to the evaporation process, vacuum, or a very low pressure, will prevail in the plate interspaces. This low pressure requires a strengthening sheet, or a so called vacuum sheet, which is provided between the second end plate, the so called pressure plate, and the proximate outermost heat exchanger plate. The strengthening sheet has to be thick, for instance more than 5 mm, in order to resist the low pressure without being deformed. The thickness is determined by, among other things, the size of the portholes. The larger the portholes the thicker strengthening sheet is needed. In the cases that the media, which are transported through the plate heat exchanger, comprise corroding or degrading substances, such as caustic soda, the strengthening sheet in addition has to be manufactured in a resistant material, advantageously the same material in which the heat exchanger plates are manufactured, for instance a material consisting of at least one of Ti, Ni and alloys thereof, or more noble stainless steel alloys. This means that the strengthening sheet becomes very expensive.

SUMMARY OF THE INVENTION

The object of the present invention is to overcome the problems mentioned above, and especially the need of a thick and expensive strengthening sheet.

This object is achieved by the plate heat exchanger initially defined, which is characterized in the said first porthole areas of the heat exchanger plates of the second outermost plate pair form portholes for the first porthole channels and said second porthole areas of at least one of the heat exchanger plates of the second outermost plate pair are closed.

Since the second porthole areas of the second outermost plate pair are closed, the second medium, for instance the product, will not be able to reach the plate or sheet, for instance a strengthening sheet, lying outside thereof. The requirement of expensive materials of this plate lying outside thereof may therefore be removed. In such a way, the plate or sheet, for instance a strengthening sheet, lying outside thereof, may be manufactured to a lower cost.

Furthermore, the second outermost plate pair will absorb at least a part of the stresses arising due to the low pressure of the second medium when the porthole areas for this medium are closed. This contributes to the possibility of making the plate or sheet, lying outside thereof, thinner and thus to a lower cost.

According to an embodiment of the invention, the plate heat exchanger comprises a strengthening sheet, which is provided between the second end plate and the second outermost plate pair, wherein the strengthening sheet adjoins the second outermost plate pair and the portholes of the first porthole areas thereof. Thanks to the closed second porthole areas, such a strengthening sheet may thus be made thinner and manufactured in a less sophisticated material. Advantageously, the strengthening sheet may be manufactured in stainless steel. Furthermore, the strengthening sheet may advantageously be plane or substantially plane. The strengthening sheet is thus even and lacks corrugations.

According to a further embodiment of the invention, gaskets are provided around the portholes of the first porthole areas between the second outermost plate pair and the strengthening sheet. In such a way, the first medium is prevented from passing between the strengthening sheet and the second outermost plate pair.

According to a further embodiment of the invention, the heat exchanger plates in each plate pair are permanently joined to each other. In such a way, plate pairs in the form of so called cassettes are created, which may be provided beside each other during the mounting of the plate heat exchanger. Advantageously, the heat exchanger plates in each plate pair may be permanently joined to each other by means of one or several weld joints, which extend at least around the heat exchanger plates in an edge area. Advantageously, each plate pair encloses one of said first plate interspaces for the first medium.

According to a further embodiment of the invention, the second porthole areas of at least one of the heat exchanger plates of the second outermost plate pair is formed by a closed plate portion which is a part of the heat exchanger plate. Such a closed plate portion may for instance be obtained in that portholes are not made in the second porthole areas during punching of the remaining portholes of the heat exchanger plate in connection with the manufacturing thereof. It is to be noted that one of the heat exchanger plates or both heat exchanger plates of the second outermost plate pair may have such a closed plate portion of the second porthole areas. Advantageously, at least one of said closed plate portions of the second porthole areas comprises a corrugation. By means of such a corrugation the strength and the capability of the porthole area to resist the above mentioned low pressure in the plate heat exchanger are increased. The corrugation may for instance comprise ridges and valleys extending in parallel with each other over at least one of the second porthole areas.

According to a further embodiment of the invention, the second porthole areas of the heat exchanger plates of the second outermost plate pair are formed by a respective closed plate portion which is a part of the respective heat exchanger plate, wherein these plate portions for at least one of the second porthole areas are permanently joined to each other by means of at least one respective joint extending over said second porthole areas. Also such a permanent joining of these plate portions increases the strength of the porthole areas, and thus there capability of resisting the above mentioned low pressure in the plate heat exchanger. A very good strength is achieved if the plate portions both are permanently joined to each other and exhibit the above mentioned corrugation. The plate portions may for instance be joined to each other by means of one or several weld joints.

According to a further embodiment of the invention, said first porthole areas of the heat exchanger plates of the second outermost plate pair form portholes for the first porthole channels.

According to a further embodiment of the invention, gaskets are provided around the first porthole areas between adjacent plate pairs, wherein said adjacent plate pairs form said second plate interspace for the second medium between themselves.

According to a further embodiment of the invention, the heat exchanger plates are manufactured in a material consisting of at least one of Ti, Ni and alloys thereof, or more noble stainless steel alloys.

BRIEF DESCRIPTION OF THE DRAWINGS

The invention is now to be explained more closely through a description of various embodiments and with reference to the drawings attached hereto.

DETAILED DESCRIPTION OF VARIOUS EMBODIMENTS OF THE INVENTION

Figure 1:
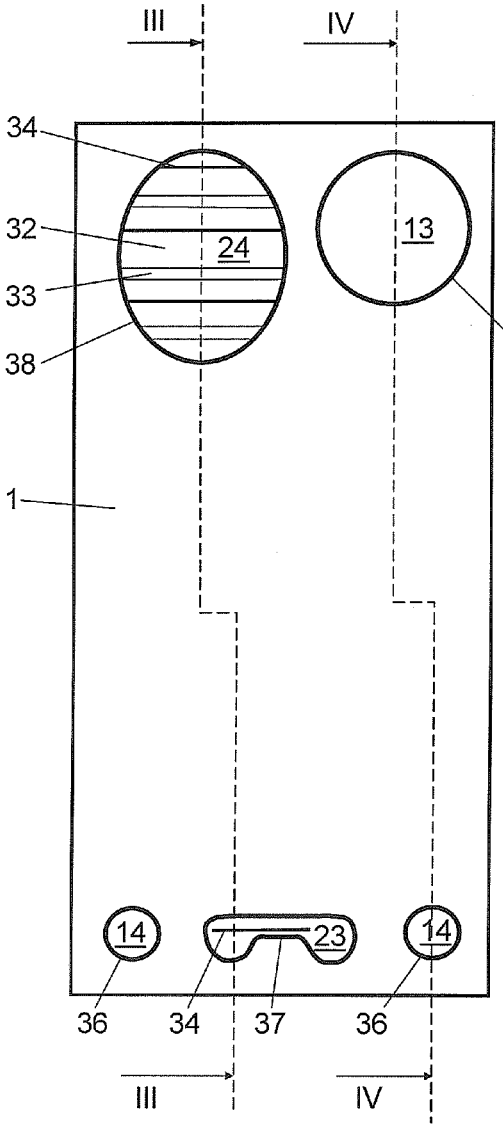
FIG. 1 discloses a plan view of a plate heat exchanger according to invention.

With reference to the drawings attached, a plate heat exchanger for a first medium and a second medium is disclosed. In the embodiments disclosed, the first medium is a heating medium which deliver heat through condensation, and the second medium is a product to be evaporated.

The plate heat exchanger comprises a first end plate 1, a second end plate 2 and a number of heat exchanger plates 3, which are provided and pressed against each other between the first end plate 1 and the second end plate 2. The heat exchanger plates 3 form a plate package and are provided and configured in such a way that first plate interspaces I and second plate interspaces II are formed in an alternating order between the first end plate 1 and the second end plate 2. Each heat exchanger plate 3 comprises, in a manner known per se, a central heat exchanger surface 10 with a schematically indicated corrugation of ridges and valleys, or other projections and depressions, in order to guide the flowing in the plate interspaces and to improve the heat transfer. The corrugation also contributes to an increased strength of the plate heat exchanger, and forms support points of the heat exchanger plates 3 pressed against each other in the plate package.

The heat exchanger plates 3 are provided in pairs and form a number of plate pairs including a first outermost plate pair 5 inside the first end plate 1, a second outermost plate pair 6 inside the second end plate 2 and intermediate plate pairs 7 between the first outermost plate pair 5 and the second outermost plate pair 6. The heat exchanger plates 3 in each plate pair 5, 6, 7 are permanently joined to each other. In the embodiment disclosed, the permanent joining has been produced by means of a weld joint 8 which is disclosed as a continuous line in FIG. 2, and which extends at least along an edge area 9 and outside the heat exchanger surface 10. Each plate pair 5, 6, 7 thus forms a unit or cassette joined in advance. Each plate pair 5, 6, 7 encloses one of the first plate interspaces I for the first medium as can be seen in FIGS. 3 and 4.

The heat exchanger plates 3 and the first end plate 1 comprise first porthole areas 11, 12, which enable the formation of first porthole channels 13, 14 forming inlet and outlet for the first medium to and from the first plate interspaces I. In the embodiment disclosed, there is a first porthole area 11, which forms a first porthole channel 13 forming an inlet for the first medium, and two second porthole areas 12, which forms two second porthole channels 14 forming an outlet for the first medium. Furthermore, the heat exchanger plates 3 and the first end plate 1 comprise second porthole areas 21, 22, which enables the formation of second porthole channels 23, 24 forming inlet and outlet for the second medium to and from the second plate interspaces II. The second porthole channel 23 then forms an inlet for the second medium, and the second porthole channel 24 forms an outlet for the second medium.

Figure 3:
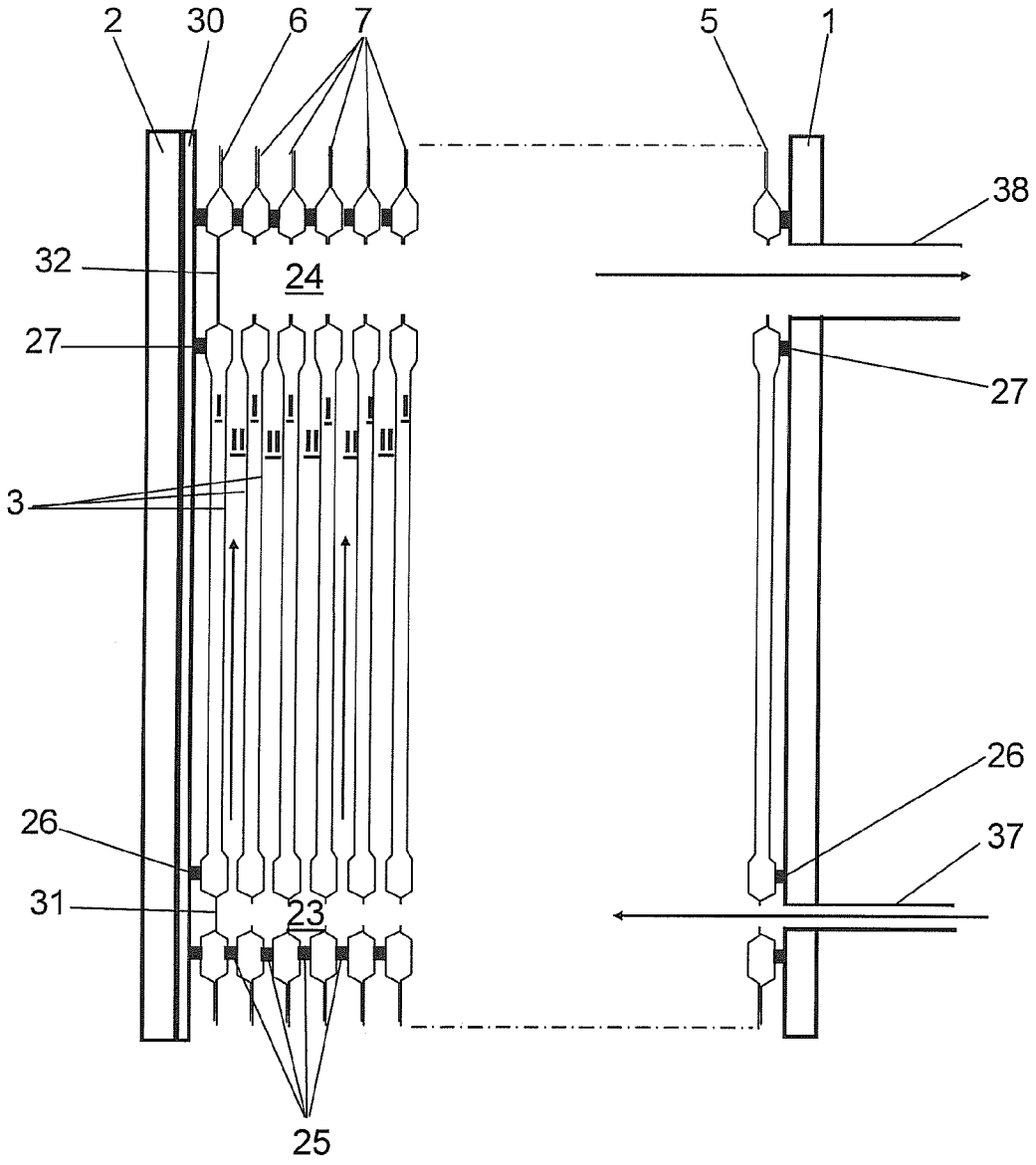
FIG. 3 discloses a sectional view along line III-III in FIG. 1.
Figure 4:
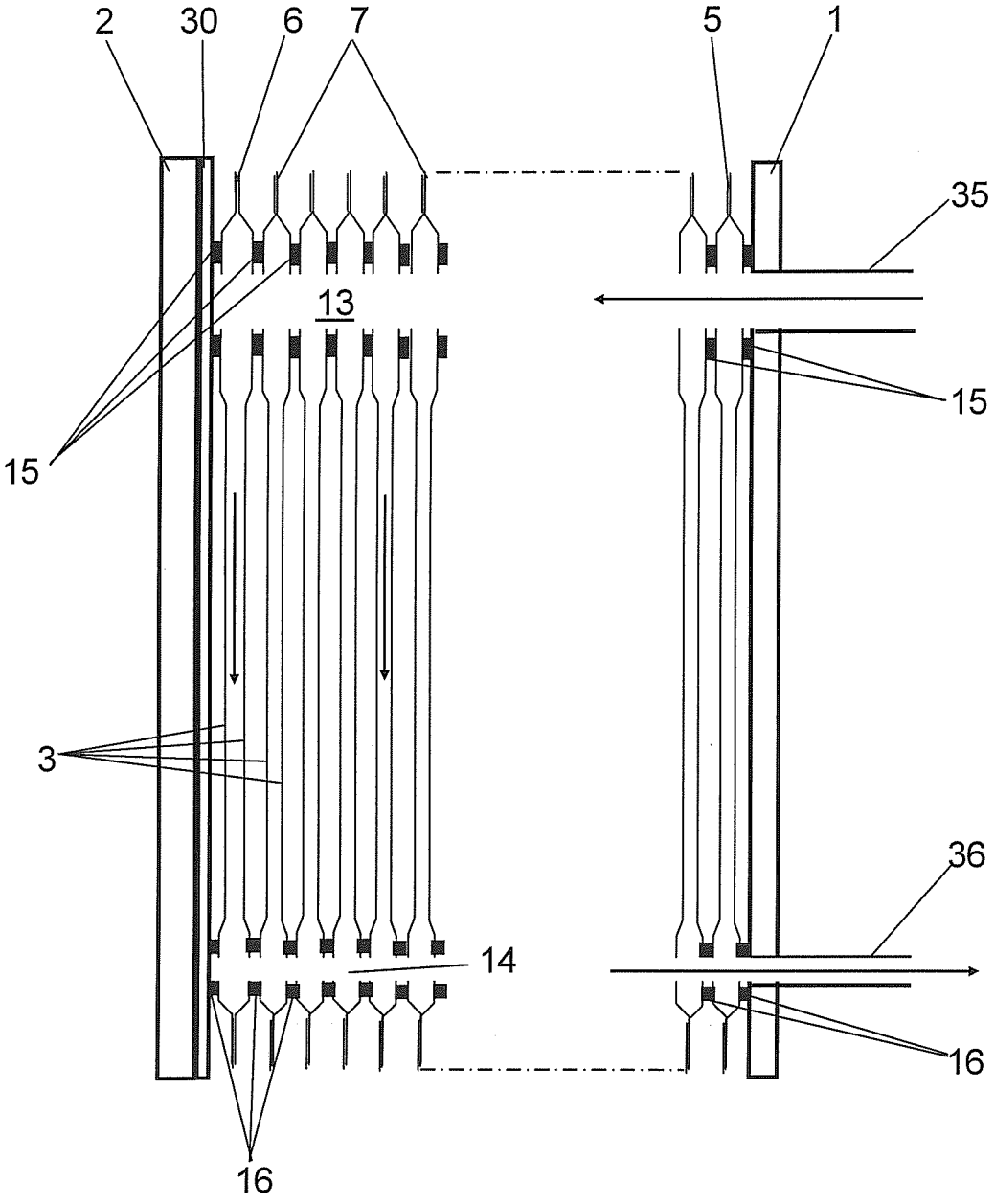
FIG. 4 discloses a sectional view along the line IV-IV in FIG. 1.

The plate heat exchanger also comprises a strengthening sheet 30, which form a so called vacuum sheet, and which is provided between the second end plate 2 and the second outermost plate pair 6 see FIGS. 3 and 4. A gasket 15 extends around the first porthole channels 13 and a gasket 16 extends around the first porthole channels 14 between adjacent plate pairs 5, 6, 7, between the first outermost plate pair 5 and the first end plate 1, and between the second outermost plate pair 6 and the strengthening sheet 30. A gasket 25 extends around the second porthole channels 21 and 22, and also around the central heat exchanger surface 10 between adjacent plate pairs 5, 6, 7. The plate heat exchanger also comprises a respective gasket 26 between the second outermost plate pair 6 and the strengthening sheet 30, and between the first outermost plate pair 5 and the first end plate 1. This gasket 26 extends around and delimits the porthole area 21. Furthermore, the plate heat exchanger comprises a respective gasket 27 between the second outermost plate pair 6 and the strengthening sheet 30, and between the first outermost plate pair 5 and the first end plate 1. This gasket 27 extends around and delimits the porthole area 22.

The plate heat exchanger also comprises connection pipes, which are fixably provided in the first end plate 1 and in line with a respective porthole channel. More precisely, the connection pipes comprise, in the embodiments disclosed, an inlet pipe 35 for the first medium in line with the first porthole channel 13, two outlet pipes 36 for the first medium in line with the two first porthole channels 14, an inlet pipe 37 for the second medium in line with the second porthole channel 23 and an outlet pipe 38 for the second medium in line with the second porthole channel 24.

The strengthening sheet 30 thus adjoins the second outermost plate pair 6 and the porthole areas 11, 12, 21, 22 of this plate pair 6. The strengthening sheet 30 is plane, or substantially plane. In order to achieve a proper sealing between the strengthening sheet 30 and the gaskets 15, 16, 26, 27, it is important that the strengthening sheet 30 is plane and has an even, or substantially completely even surface. The strengthening sheet 30 may be made thin, for instance 2 mm, 1 mm or less. The strengthening sheet 30 may furthermore be manufactured in any conventional material such as stainless steel. The heat exchanger plates 3 may, however, be manufactured in more sophisticated or exotic materials, including or consisting of Ti, Ni or alloys thereof, or possibly more noble stainless steel alloys, in order to resist attacks from aggressive substances in the second and/or first medium.

Figure 2:
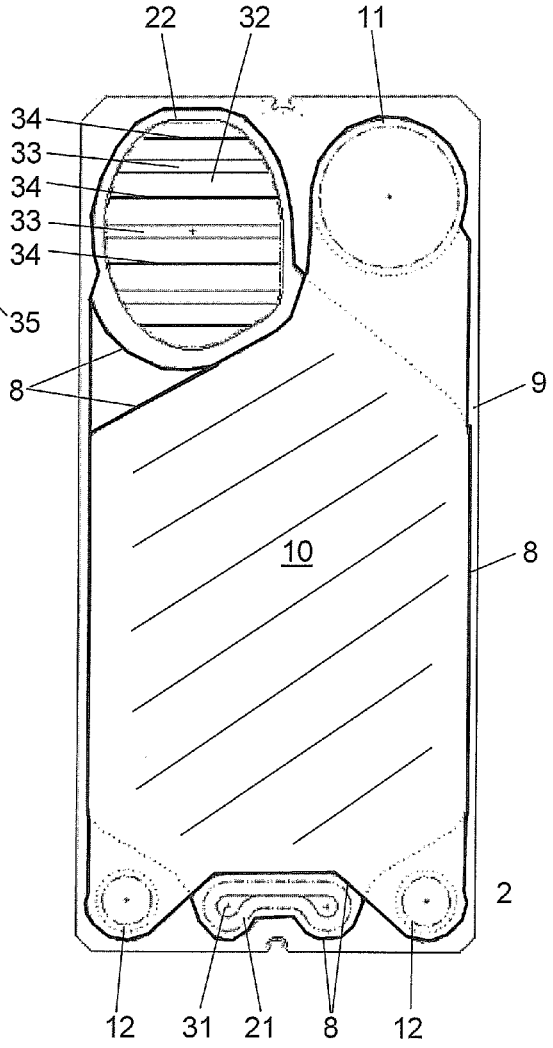
FIG. 2 discloses a plan view of a second outermost plate pair of the plate heat exchanger in FIG. 1.

The second outermost plate pair 6, which is disclosed in a plan view in FIG. 2 and in a sectional view from the side in FIGS. 3 and 4, adjoins the second end plate 2 and comprises the first porthole areas 11, 12, forming portholes for the first porthole channels 13 and 14, see FIGS. 2 and 4. Furthermore, the heat exchanger plates 3 of the second outermost plate pair 6 comprise said second porthole areas 21 and 22, which are closed as can be seen in FIGS. 2 and 3, i.e. no medium can pass through these porthole areas 21, 22. In the embodiments disclosed, both heat exchanger plates 3 of the second outermost plate pair 6 are closed in the second porthole area 21 and 22, i.e. these porthole areas 21 and 22 comprise a respective closed plate portion 31, 32 which is a part of the heat exchanger plate 3. These closed plate portions 31, 32 of these two heat exchanger plates 3 have been produced in that the porthole areas 21 and 22 have not been punched during the manufacturing and punching of the remaining portholes of the heat exchanger plates 3. As can be seen in FIGS. 1 and 2, at least the closed portion 32 of the second porthole area 22 comprises a corrugation 33 of ridges and valleys extending in parallel with each other transversally over the closed plate portion 32. It is to be noted that also the closed plate portions of the second porthole area 21 may comprise a corresponding corrugation of ridges and valleys.

Furthermore, the plate portions 32 of the second porthole areas 22 are joined to each other by means of one or several weld joints 34, see FIG. 2. Also the closed plate portions 31 of the second porthole area 21 may be joined to each other by means of a weld joint 34.

It is to be noted that it is possible to let merely one of the heat exchanger plates 3 of the second outermost plate pair 6 comprise said closed plate portion 31, 32 of the second porthole areas 21 and 22, whereas the second heat exchanger plate 3 comprises a porthole in the ordinary manner in these portholes areas 21 and 22. A weld joint then suitable extends around the porthole and joins the two heat exchanger plates 3 to each other along this edge.

According to another embodiment, it is possible to let also the first porthole areas 11, 12 for the first porthole channels 13, 14 for the first medium be closed for the second outermost plate pair 6. One or both of the heat exchanger plates 3 of the second outermost plate pair 6 may then comprise a respective closed plate portion at the first porthole areas 11, 12. In particular in such an embodiment, it may also be possible to dispense with the strengthening sheet 30.

The invention is not limited to the embodiments disclosed above but may be varied and modified within the scope of the following claims. It is to be noted that the plate heat exchanger may be used in many different applications, and not only for evaporation of a product to be manufactured.

What is claimed is:

1. A plate heat exchanger configured to be used as an evaporator for evaporating a second medium by using a first medium, wherein the plate heat exchanger comprises a first end plate, a second end plate, and a number of heat exchanger plates provided between the first end plate and the second end plate and configured to form first plate interspaces and second plate interspaces arranged in an alternating order, wherein the heat exchanger plates comprise a first outermost plate pair, which forms a first one of the first plate interspaces inside the first end plate, the first one of the first plate interspaces constituting the interspace closest to the first end plate, the first outermost plate pair containing two heat exchanger plates of said number of heat exchanger plates that are arranged closest to the first end plate, a second outermost plate pair, which forms a second one of the first plate interspaces inside the second end plate, the second one of the first plate interspaces constituting the interspace closest to the second end plate, the second outermost plate pair containing two heat exchanger plates of said number of heat exchanger plates that are arranged closest to the second end plate, and intermediate plate pairs, each of which forms one of the first plate interspaces between the first outermost plate pair and the second outermost plate pair, wherein the first end plate and the heat exchanger plates comprise first porthole areas enabling the formation of first porthole channels, which form an inlet and an outlet for the first medium to and from the first plate interspaces, and second porthole areas, enabling the formation of second porthole channels, which form an inlet and an outlet for the second medium to and from the second plate interspaces, wherein said first porthole areas of the heat exchanger plates of the second outermost plate pair are open portholes, wherein said second porthole areas of at least one of the heat exchanger plates of the second outermost plate pair are closed by closed plate portions which are part of the at least one heat exchanger plate, and the plate heat exchanger comprises a strengthening sheet, which is provided between the second end plate and the second outermost plate pair, wherein the strengthening sheet adjoins the second outermost plate pair, adjoins the second porthole areas of the second outermost plate pair, and adjoins the open portholes of the first porthole areas of the second outermost plate pair so that the first porthole channels allow the first medium to reach the strengthening sheet, and wherein said closed second porthole areas closed by said closed plate portions prevent the second medium from reaching the strengthening sheet.

2. The plate heat exchanger according to claim 1, wherein the strengthening sheet is made of stainless steel.

3. The plate heat exchanger according to claim 1 or 2, wherein the strengthening sheet is planar.

4. The plate heat exchanger according to claim 1 or 2, wherein a gasket is provided around the portholes of the second porthole areas between the second outermost plate pair and the strengthening sheet.

5. The plate heat exchanger according to claim 1 or 2, wherein a gasket is provided around the portholes of the first porthole areas between the second outermost plate pair and the strengthening sheet to provide a seal between the gasket and the strengthening sheet.

6. The plate heat exchanger according to claim 1 or 2, wherein the heat exchanger plates in each plate pair are permanently joined to each other.

7. The plate heat exchanger according to claim 1, wherein at least one of said closed plate portions of the second porthole areas comprises a corrugation.

8. The plate heat exchanger according to claim 7, wherein the second porthole areas of the heat exchanger plates of the second outermost plate are formed by a respective closed plate portion which is a part of the respective heat exchanger plate, wherein these plate portions for at least one of the second porthole areas are permanently joined to each other by at least one respective joint extending over said second porthole areas.

9. The plate heat exchanger according to claim 1 or 2, wherein said first porthole areas of each heat exchanger plate of the second outermost plate pair form portholes for the first porthole channels.

10. The plate heat exchanger according to claim 1 or 2, wherein a gasket is provided around the first porthole areas between adjacent plate pairs, and said adjacent plate pairs form said second plate interspace for the second medium between themselves.

11. The plate heat exchanger according to claim 1 or 2, wherein the heat exchanger plates are made of a material comprising at least one of Ti, Ni and alloys thereof, or more noble stainless steel alloys.

* * * * *